United States Patent [19]

McGuffey

[11] 4,368,745

[45] Jan. 18, 1983

[54] PRECISION COMB

[76] Inventor: Patrick J. McGuffey, 1 S. 289 Ingersoll La., Villa Park, Ill. 60181

[21] Appl. No.: 280,446

[22] Filed: Jul. 6, 1981

[51] Int. Cl.[3] ..... A45D 24/36

[52] U.S. Cl. ..... 132/45 A; 132/11 R; 33/334

[58] Field of Search ..... 132/45 R, 45 A, 45 B, 132/104, 125, 144, 145, 147, 11; 33/370, 334, 391

[56] References Cited

U.S. PATENT DOCUMENTS

| | | | |
|---|---|---|---|
| 2,879,777 | 3/1959 | Miller | 33/334 |
| 3,028,679 | 4/1962 | Christy | 33/391 |
| 3,877,472 | 4/1975 | D'Angelo | 132/145 |

FOREIGN PATENT DOCUMENTS

| | | | |
|---|---|---|---|
| 1234502 | 9/1959 | France | 132/11 R |

*Primary Examiner*—Robert A. Hafer

[57] ABSTRACT

A precision comb which has, generally, a one piece molded body portion, including a plurality of comb teeth, and a pendulum pivotally secured to the body portion so that the pendulum normally is vertically disposed when the comb is horizontally disposed. The body portion also has indicia provided on it in operative relationship with the pendulum to visually indicate to the user the angular disposition of the comb during use. The user, therefore, can easily and quickly determine the angle at which the comb is being held, and hence, the angle at which the hair is being trimmed. The comb further has a slot provided in its body portion which is horizontally disposed parallel with the comb teeth. A scissors can be extended through this slot to cut the hair.

2 Claims, 3 Drawing Figures

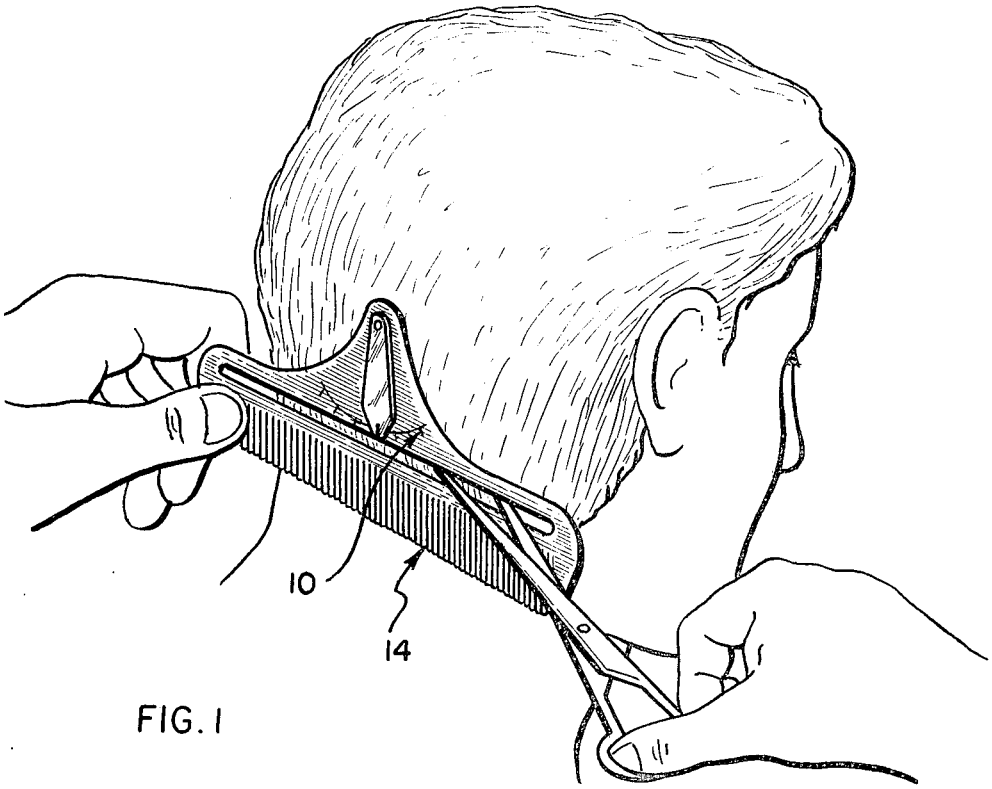
FIG. 1
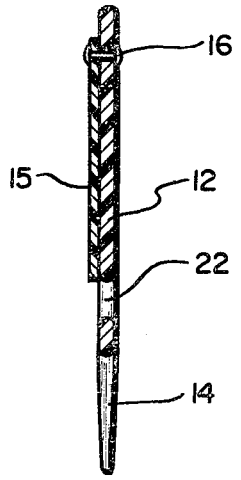
FIG. 3
FIG. 2
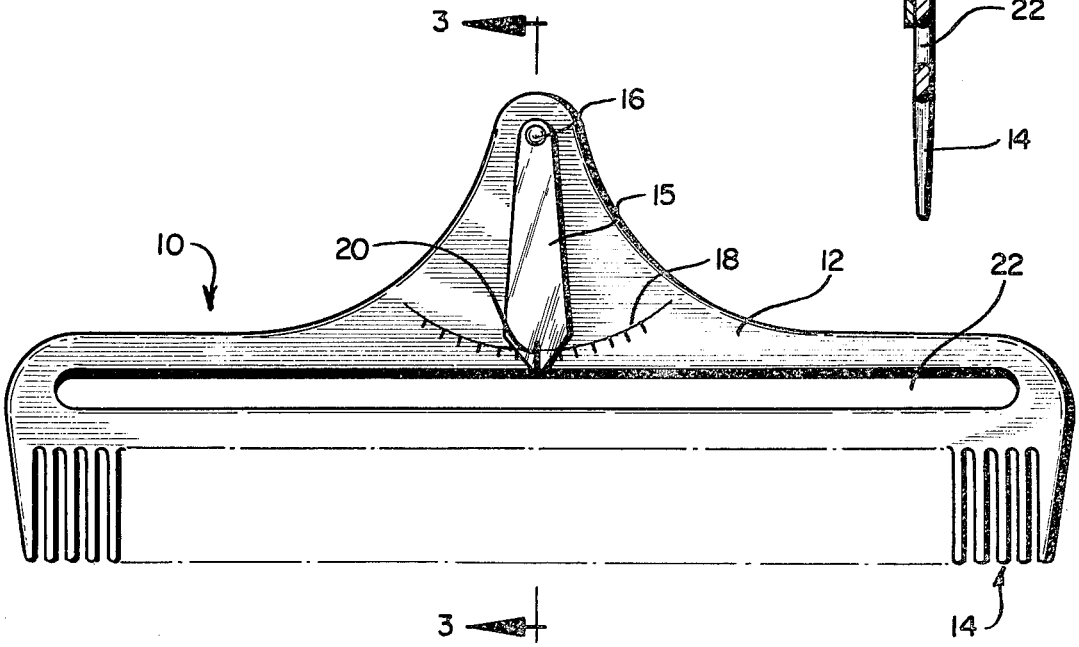

PRECISION COMB

BACKGROUND AND SUMMARY OF THE INVENTION

This invention relates generally to combs and in particular to an improved precision comb for trimming bangs, necklines, and to angle the hair.

The comb in the present invention is particularly useful for trimming bangs, necklines, and to angle the hair, so that the hair can be trimmed and kept neat between haircuts. The comb therefore can be used to lengthen the period of time between haircuts, and thus provide savings to the user. In this respect, the comb is inexpensively fabricated and is simple in construction and use, so that the average person can easily purchase and utilize it.

Accordingly, it is an object of the present invention to provide an improved precision comb for trimming hair, particularly bangs and necklines and for angling the hair.

The above as well as other objectives are provided by the precision comb of the invention which has, generally, a one piece molded body portion, including a plurality of comb teeth, and a pendulum pivotally secured to the body portion so that the pendulum normally is vertically disposed when the comb is horizontally disposed. The body portion also has indicia provided on it in operative relationship with the pendulum to visually indicate to the user the angular disposition of the comb during use. The user, therefore, can easily and quickly determine the angle at which the comb is being held, and hence the angle at which the hair is being trimmed. The comb further has a slot provided in its body portion which is horizontally disposed parallel with the comb teeth. A scissors can be extended through this slot to cut the hair.

Many other objects and purposes of the invention will be clear from the following detailed description of the invention.

BRIEF DESCRIPTION OF THE DRAWINGS

FIG. 1 is a perspective view generally illustrating the manner in which the comb may be used to trim the neckline;

FIG. 2 is a front planned view of the comb; and

FIG. 3 is a sectional view taken along lines 3—3 of FIG. 2.

DESCRIPTION OF THE PREFERRED EMBODIMENT

Referring now to the drawing, a precision comb 10 exemplary of the invention is illustrated. The comb 10 has a body portion 12 including a plurality of comb teeth 14, as is conventional with all combs.

In this case, the comb 10 has a pendulum 15 pivotally affixed by means of a pivot pin 16 to the body portion 12. In the illustrated embodiment, the pendulum 15 is disposed so that it normally is vertically suspended when the comb 10 is horizontally disposed, as illustrated in FIG. 2. The body portion 12 has indicia 18 on it in functional and operative relationship with the pendulum 15 for visually indicating the angular disposition of the comb 10. The pendulum 15 likewise may have indicia in the form of a line 20 provided on it in functional and operative relationship with the indicia 18.

The comb 10 also preferably and advantageously has a slot 22 provided in it. This slot 22 extends horizontal and parallel to the comb teeth 14, between the pendulum 15 and the comb teeth 14. The slot 22 is of sufficient width to receive through it the tip of a scissors for cutting the hair, as illustrated in FIG. 1.

The comb's body portion 12 can be molded of and the pendulum 15 can be easily stamped from a plastic material. The only required assembly is affixing the pendulum 15 to the comb 10, and this can be easily and quickly accomplished. Accordingly, it is apparent that the comb 10 can be inexpensively fabricated.

Using the comb 10, as illustrated in FIG. 1, to trim the neckline, for example, the comb 10 is simply combed through the hair and the tip of a scissors is extended through the slot 22 to cut the hair. By observing the position of the pendulum 15 the user can easily and quickly visually observe whether the comb 10 is being held in the proper angular position to cut or trim the neckline in a straight line, or as desired. Bangs can be trimmed in a similar fashion. Angle cuts can be easily made simply by observing the position of the pendulum 15, with respect to the indicia 18.

While the comb 10 has a pendulum 15 for indicating its angular position, other means such as a bubble level likewise can be used. However, an angle indicating device such as the pendulum 15 is preferred because of its simplicity and the readily visible indication provided by it. Also, while it is preferred that the slot 22 be provided in the comb 10 since it provides a ready means for making straight cuts when used in conjunction with the pendulum 15 it obviously could be eliminated.

Many changes and modifications in the above described embodiment of the invention can, of course, be carried without departing from the scope thereof. Accordingly, that scope is intended to be limited only by the scope of the appended claims.

I claim:

1. A precision comb for trimming bangs, necklines and to angle the hair comprising, in combination, a body portion including a plurality of comb teeth, and angle indicating means affixed to said body portion for indicating the angular disposition of said comb, whereby the user of the comb can easily and quickly determine the angle at which the comb is being held, said angle indicating means comprising a pendulum pivotally secured to said body portion so as to normally be vertically disposed when said comb is horizontally disposed, indicia on said body portion in operative relationship with said pendulum for visually indicating the angular disposition of said comb, and a slot in said body portion for receiving therethrough a scissors for cutting the hair, said slot extending horizontally parallel with said plurality of comb teeth.

2. The precision comb of claim 1, wherein said slot is disposed in said body portion beneath said pendulum and between said pendulum and said plurality of comb teeth.

* * * * *